US008629812B2

(12) United States Patent
Jaffri et al.

(10) Patent No.: US 8,629,812 B2
(45) Date of Patent: Jan. 14, 2014

(54) CAVITY BACKED CROSS-SLOT ANTENNA APPARATUS AND METHOD

(75) Inventors: Rehan K. Jaffri, New York, NY (US); Richard T. Knadle, Dix Hills, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 180 days.

(21) Appl. No.: 13/308,873

(22) Filed: Dec. 1, 2011

(65) Prior Publication Data

US 2013/0141296 A1 Jun. 6, 2013

(51) Int. Cl.
*H01Q 13/10* (2006.01)

(52) U.S. Cl.
USPC ..... 343/770; 343/767

(58) Field of Classification Search
USPC ..... 343/770, 767, 700 MS, 850
See application file for complete search history.

(56) References Cited

U.S. PATENT DOCUMENTS 3,969,730 A 7/1976 Fuchser
4,032,921 A 6/1977 Sikina, Jr. et al.
4,242,685 A 12/1980 Sanford
4,315,266 A 2/1982 Ellis, Jr.
5,241,321 A * 8/1993 Tsao ..... 343/700 MS
5,581,266 A * 12/1996 Peng et al. ..... 343/770
6,031,503 A 2/2000 Preuss, II et al.
6,414,642 B2 7/2002 Honda et al.
6,507,320 B2 * 1/2003 Von Stein et al. ..... 343/770
6,507,322 B2 1/2003 Fang et al.
6,650,299 B2 * 11/2003 Zhang et al. ..... 343/770
6,788,266 B2 9/2004 St. Hillaire et al.
6,911,952 B2 * 6/2005 Sievenpiper et al. ..... 343/770
7,064,725 B2 6/2006 Shtrikman et al.
7,091,920 B2 * 8/2006 Yuanzhu ..... 343/770
8,120,536 B2 * 2/2012 Lindmark ..... 343/700 MS

* cited by examiner

*Primary Examiner* — Hoang V Nguyen

(57) ABSTRACT

An antenna apparatus and method includes an orthogonal slot antenna which overcomes the limitations associated with RF choke between the adjacent slots through various feed techniques. A cavity backed cross-slot antenna includes a horizontal slot antenna, a vertical slot antenna sharing a center portion with the horizontal slot antenna, a first feed for the horizontal slot antenna, and a second feed for the vertical slot antenna, the first feed and the second feed provided to the shared center portion. Another cavity backed cross-slot antenna includes a horizontal slot antenna, a vertical slot antenna, the horizontal slot antenna and the vertical slot antenna share a center portion therebetween, a first feed feeding both halves of the horizontal slot antenna, and a second feed feeding both halves of the vertical slot antenna.

20 Claims, 3 Drawing Sheets

CAVITY BACKED CROSS-SLOT ANTENNA APPARATUS AND METHOD

FIELD OF THE DISCLOSURE

The present disclosure relates generally to wireless antennas and, more particularly, to a cavity backed cross-slot antenna apparatus and method.

BACKGROUND

Polarization diversity between orthogonal polarizations is a key requirement to various antenna applications. For achieving polarization diversity, antennas are often placed orthogonal to each other, which in many balanced antenna designs, rotates the fields by 90 degrees providing true polarization diversity. Some designs take it one step further and overlap antennas (in the min Electric field region) to occupy minimum space and/or volume. One such example is shown in FIG. 1, i.e. an orthogonal dipole arrangement 10. The arrangement 10 includes orthogonal half-wavelength dipole antennas 12, 14 with no corresponding Radio Frequency (RF) choke problems. This is due to the half-wavelength dipole antennas 12, 14 each including balanced feeds 16, 18 at a center portion, i.e. the half-wavelength dipole antennas 12, 14 do not interact electrically. However, this is not possible for a conventional slot antenna 20 as depicted in a top view in FIG. 2 and a side view in FIG. 3. The slot antenna 20 includes a horizontal slot antenna 22 and a vertical slot antenna 24 disposed on an RF ground 26. Each of the antennas 22, 24 are fed at a side point with feeds 28, resulting in the horizontal slot antenna 22 acting as an RF choke to the other half of the vertical slot antenna 24 and vice versa. That is, the antenna 20 forms a $\lambda/4$ wavelength cavity ending in an RF short.

Accordingly, there is a need for a cavity backed cross-slot antenna apparatus and method overcoming the aforementioned limitations.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
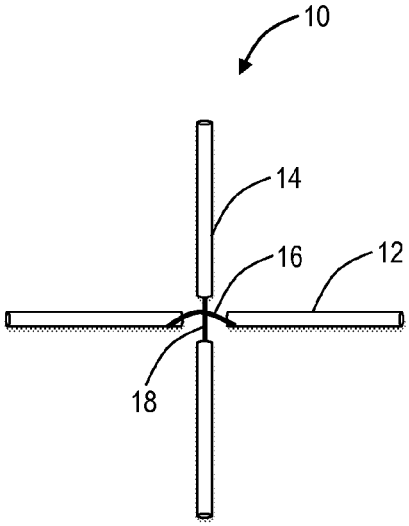
FIG. 1 Prior Art
FIG. 1 is a perspective diagram of an orthogonal dipole arrangement in accordance with conventional embodiments.
Figure 3:
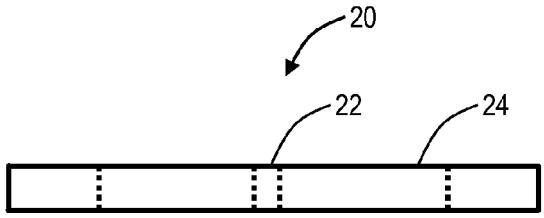
FIG. 3 Prior Art
FIG. 3 is a side view of the slot antenna of FIG. 2 in accordance with conventional embodiments.
Figure 2:
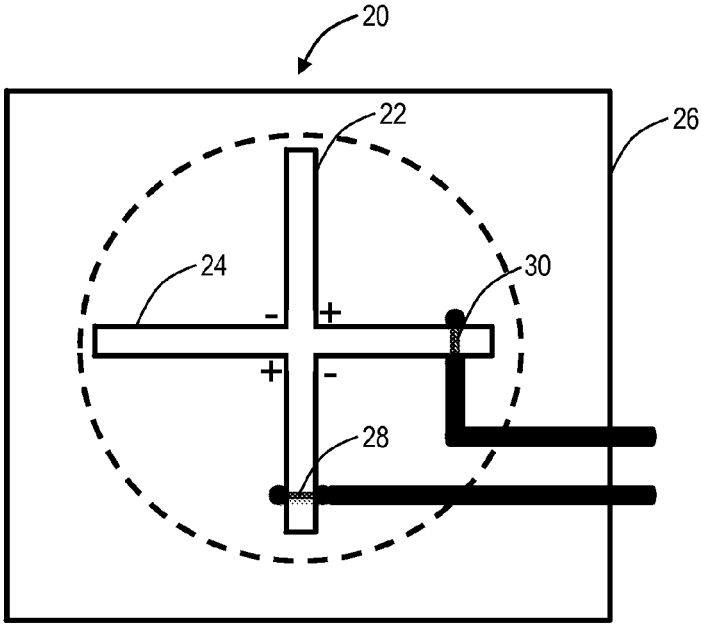
FIG. 2 Prior Art
FIG. 2 is a top view of a slot antenna in accordance with conventional embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

In various exemplary embodiments, the present disclosure provides a cavity backed cross-slot antenna apparatus and method. In particular, the antenna apparatus and method includes an orthogonal slot antenna which overcomes the aforementioned limitations associated with an RF choke between the adjacent slots. Various feeding techniques are described herein to avoid RF choking when designing overlapping slot antennas for achieving polarization diversity. Variously, the antenna apparatus and method includes a co-located, cross polarized, orthogonal, cavity-backed slot antenna with minimum cross coupling.

In an exemplary embodiment, a cavity backed cross-slot antenna includes a horizontal slot antenna, a vertical slot antenna sharing a center portion with the horizontal slot antenna, a first feed for the horizontal slot antenna, and a second feed for the vertical slot antenna, the first feed and the second feed provided to the shared center portion. The cavity backed cross-slot antenna may further include a ground plate disposed to the horizontal slot antenna and the vertical slot antenna. The horizontal slot antenna and the vertical slot antenna may be one of integrally formed in the ground plate and disposed on the ground plate. The horizontal slot antenna and the vertical slot antenna may be overlapping therebetween with the overlapping forming the shared center portion.

The first feed and the second feed may be positioned diagonally with respect to one another at the shared center portion. The horizontal slot antenna and the vertical slot antenna may be orthogonal to one another. The horizontal slot antenna, the vertical slot antenna, the first feed, and the second feed may create a slant±45° polarization for the cavity backed cross-slot antenna thereby achieving orthogonal polarization diversity. The first feed and the second feed may each feed the pair of slot antennas, simultaneously, with a signal phase combination that will provide isolation between the +45 degree polarization of the radiated signal. Because the slot antennas are being fed at the high impedance point, a means such as an "L" network or a PI network can be employed at that point (or remotely) that can accommodate impedance matching to approximately 1,000Ω. The horizontal slot antenna and the vertical slot antenna may also be slightly asymmetrical to one another.

In yet another exemplary embodiment, a cavity backed cross-slot antenna includes a horizontal slot antenna, a vertical slot antenna with the horizontal slot antenna and the vertical slot antenna share a center portion therebetween, a first feed feeding both halves of the horizontal slot antenna, and a second feed feeding both halves of the vertical slot antenna. The cavity backed cross-slot antenna may further include a ground plate disposed to the horizontal slot antenna and the vertical slot antenna. The horizontal slot antenna and the vertical slot antenna may be one of integrally formed in the ground plate and disposed on the ground plate. The horizontal slot antenna and the vertical slot antenna may be overlapping therebetween, the overlapping forming the shared center portion.

The first feed may symmetrically feed both the halves of the horizontal slot antenna and the second feed symmetrically feeds both the halves of the vertical slot antenna, the symmetrically feeding provides equal excitation to each half of the horizontal slot antenna and to each half of the vertical slot antenna. The horizontal slot antenna and the vertical slot antenna may be orthogonal to one another. The shared center portion may be partially capacitive to compensate inductance.

Each of the first feed and the second feed may include a common portion, a split portion comprising a first half and a second half, the first half and the second half coupled therebetween and coupled to the common portion, and a first feed portion coupled to the first half and to one of the halves of one of the horizontal slot antenna and the vertical slot antenna. A length of the first half of the split portion and the first feed portion is approximately equal to one half of a wavelength associated with the cavity backed cross-slot antenna, and a length of the second half of the split portion and the second feed portion is approximately equal to one half of a wavelength associated with the cavity backed cross-slot antenna. The first feed and the second feed may be non-overlapping therebetween.

In yet another exemplary embodiment, a method includes providing a horizontal slot antenna and a vertical slot antenna overlapping therebetween in a shared center portion, the horizontal slot antenna and the vertical slot antenna include a cavity backing, feeding each of the horizontal slot antenna and the vertical slot antenna with a feeding technique configured to alleviate radio frequency choking between the horizontal slot antenna and the vertical slot antenna due to the shared center portion, and operating the horizontal slot antenna and the vertical slot antenna with the feeding technique in a polarization diverse manner.

Figure 4:
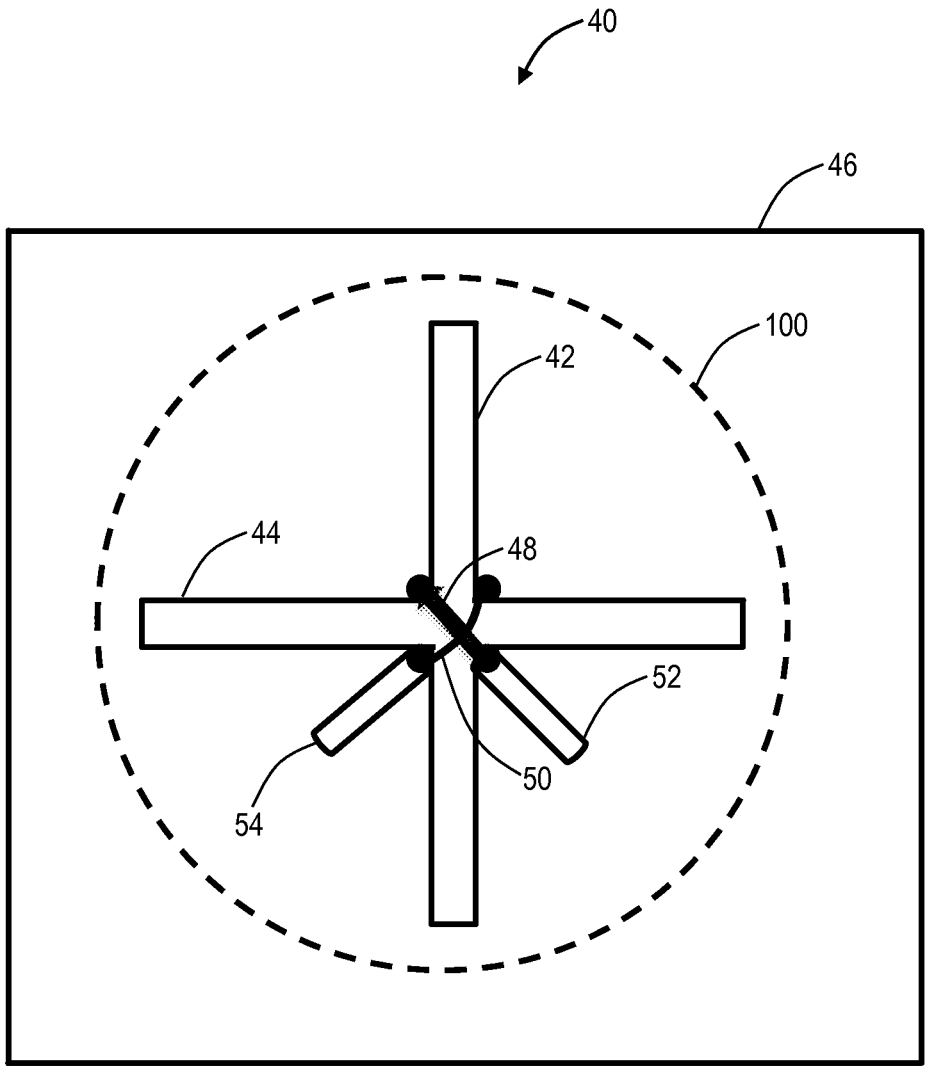
FIG. 4 is a top view of a slot antenna with a first feed technique to overcome RF choking in accordance with some embodiments.

Referring to FIG. 4, in an exemplary embodiment, a top view illustrates a slot antenna 40 with a first feed technique to overcome RF choking in accordance with some embodiments. The slot antenna 40 is a cavity backed cross-slot antenna and includes a horizontal slot (H-slot) antenna 42 and a vertical slot (V-slot) antenna 44 disposed on or formed in an RF ground 46. The first feed technique includes two feed 48, 50 positioned diagonally with respect to one another at a center of each slot antenna 42, 44 to overlap orthogonally. Further, the feeds 48, 50 are each coupled to a cable 52, 54 (a portion of which is illustrated in FIG. 4).

By feeding the slot antennas 42, 44 at the center as shown in FIG. 4 (orthogonal, overlapping, spaced—creating a certain capacitive reactance), the RF choke problem can be resolved, and the isolation between the slot antenna feeds 48, 50 can be greatly improved. Specifically, the near proximity of the spaced, but overlapping, feeds 48, 50 creates a capacitive coupling between them; this will result in a cross-coupling reactance between the feeds 48, 50 that will degrade the isolation between the feeds 48, 50. The capacitive cross-coupling can be negated (at least at the center frequency) by placing an inductor of the proper value, that is connected between the feeds 48, 50. That inductor can be placed on a printed circuit board (PCB) that is mounted at the junction. Each feed 48, 50 will also present a small series inductance due to their "unshielded" length. The series inductance can be negated by making each slotted antenna 42, 44 slightly longer than the resonant length; this will make their impedance slightly capacitive. The resulting polarization for the antenna 40 is slant±45° for two complementary polarizations. Advantageously, the antenna 40 can immunize a system from polarization mismatches that would otherwise cause signal fade. Additionally, such diversity has proven valuable for RF Identification (RFID), radio and mobile communication base stations, and the like since it is less susceptible to the near random orientations of transmitting antennas.

Figure 5:
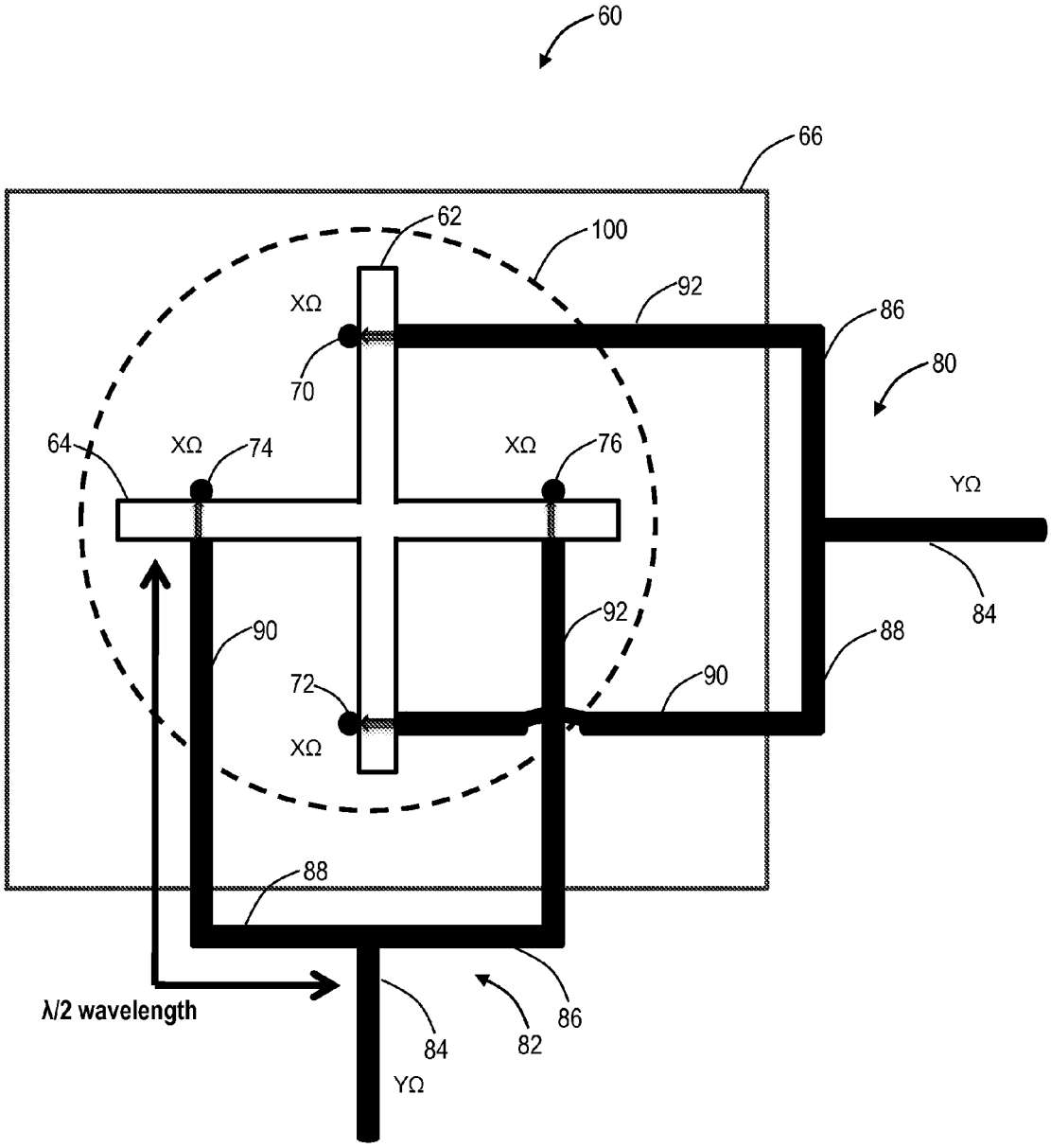
FIG. 5 is a top view of a slot antenna with a second feed technique to overcome RF choking in accordance with some embodiments.

Referring to FIG. 5, in an exemplary embodiment, a top view illustrates a slot antenna 60 with a second feed technique to overcome RF choking in accordance with some embodiments. The slot antenna 60 is a cavity backed cross-slot antenna and includes a horizontal slot (H-slot) antenna 62 and a vertical slot (V-slot) antenna 64 disposed on or formed in an RF ground 66. The second feed technique includes direct feeds 70, 72, 74, 76 feeding both halves of a particular slot antenna 62, 64. For example, the H-slot antenna 62 is fed with the feeds 70, 72 and the V-slot antenna 64 is fed with the feeds 74, 76. The inductance of the feeds 70, 72, 74, 76 across the slot antennas 62, 64 may be compensated by making the impedance of the slot antennas 62, 64 partially capacitive.

The feeds 70, 72 are coupled or disposed to a cable 80 and the feeds 74, 76 are coupled or disposed to a cable 82. That is, a feed to the H-slot antenna 62 is formed through the feeds 70, 72 and the cable 80 and a feed to the V-slot antenna 64 is formed through the feeds 74, 76 and the cable 82. The feeds 70, 72 and the cable 80 are configured to directly and symmetrically feed both halves of the H-slot antenna 62. The feeds 74, 76 and the cable 82 are configured to directly and symmetrically feed both halves of the V-slot antenna 64.

By symmetrically and simultaneously feeding both halves of the slot antennas 62, 64, equal excitation is insured of each half despite the "choking action" of a corresponding orthogonal slot. For instance, if only the upper half of the H-slot antenna 62 was fed by the feed 70, then only the upper half of H-slot antenna 62 would receive significant excitation. This is because the V-slot antenna 64 will present a high impedance choke at the center of the H-slot antenna 62, therefore little excitation will be presented to the lower half of the H-slot antenna 62. At that time V-slot antenna 64 will be receiving a cross-polarized excitation in a TE-01 mode, and it will radiate very little of that signal in the broadside manner. Therefore, there is a choking action of the V-slot antenna 64 relative to the H-slot antenna 62 and a choking action of the H-slot antenna 62 relative to the V-slot antenna 64.

Each of the cables 80, 82 includes a "goal-post" configuration where cables 84, 86, 88 form a "T" connection and cables 90, 92 forming posts thereon. That is, the cable 84 is a single feed which is split into the cables 86, 88. The cable 88 is coupled to the cable 90 that connects to the feeds 72, 74, and the cable 86 is coupled to the cable 92 that connects to the feeds 70, 76. Importantly, the cables 80, 82 are not interconnected, i.e. the cable 90 in the cable 80 does not connect to cable 92 in the cable 82. This can be accomplished by using shielded coaxial cables, or by using strip lines (for instance) that are placed on opposite sides of the conductive sheet 66. In an exemplary embodiment, a combined length of the cables 88, 90 and the cables 86, 92 are about equal in wavelength to insure a co-phase excitation of each half of the appropriate slot antenna. If one-half of a wavelength (or a multiple of one-half of a wavelength) was chosen, then the feed impedance at 70, 72, 74, 76 would be duplicated at the other end of the feed lines 90 plus 88, as well as 92 plus 86.

The cables 84 have a certain impedance Y Ω and the cables 88, 90 and their associated feed 72, 74 and the cables 86, 92 and their associated feed 70, 76 have a certain impedance X Ω. In an exemplary embodiment Y is equal to 50Ω and X is equal to 100Ω, that is at the "T" connector of a pair of 100Ω impedances are combining to feed 50Ω. However, the pair of 100Ω impedances that are bring combined at each "T" connector can be accomplished in a number of ways. For instance, if the feed locations on the slot antennas 70, 72, 74, 76 are chosen so that each equals 100Ω, and if cables 90 plus 88 and 92 plus 86 equal an integer of one-half wavelength, then all cables could be of a 50Ω impedance.

In each of the slot antenna 40, 60, the H-slot antennas 42, 62 and the V-slot antennas 44, 64 are integrally formed, disposed on, or attached to the RF ground 46, 66. The H-slot antennas 42, 62 and the V-slot antennas 44, 64 are substantially orthogonal to one another, and include a shared center portion therebetween. As described herein, the first and second feed techniques alleviate and/or improve RF choking problems associated with the shared center portion.

In an exemplary embodiment, the slot antennas 42, 44 and/or the slot antennas 62, 64 may be intentionally constructed slightly asymmetrical to one another so as to create an imbalance reactance between them (one capacitive and one inductive, for instance), which will result in a phase difference in the excitation, for the purpose of creating an elliptical or circular polarization of the radiated signal generated by each feed cable. In this manner each feed cable 48, 50, 70, 72, 74, 76 will create a particular sense of elliptical polarization that is either clockwise or counter clockwise, and each sense of the polarization will be primarily orthogonal and thus partially isolated from the other sense of polarization, and the feed cables 50, 70, 72, 74, 76 will be at least partially isolated.

In another exemplary embodiment, the slot antennas 42, 44 and/or the slot antennas 62, 64 may be intentionally constructed slightly asymmetrical to one another so as to create an imbalance reactance between them that is frequency sensitive, which will result in a phase difference in the excitation between them that is frequency sensitive, and an amplitude difference in the excitation between them that is frequency sensitive. The net result will be a composite antenna assembly where each feed cable 50, 70, 72, 74, 76 will radiate a particular sense of elliptical polarization, where the axial ratio of the radiation will change in a predictable manner as the frequency is swept. The radiated signal from each feed cable 50, 70, 72, 74, 76 will be primarily orthogonal, and the feed cables 50, 70, 72, 74, 76 will be partially isolated from each other. The degree of radiated signal orthogonality, and the degree of isolation between the feed cables 50, 70, 72, 74, 76, will each change as a function of frequency in a predictable manner.

The slot antennas 40, 60 contemplate use in a variety of devices, applications, and the like. Generally, the slot antennas 40, 60 may be used in any orthogonal, overlapping slot antenna configuration for different wireless technologies. In an exemplary embodiment, the slot antennas 40, 60 may be used in radio frequency identification (RFID) applications such as in RFID ceiling readers, fixed panel readers, hand held readers, and the like.

In other exemplary embodiments, the slot antennas 40, 60 may be used in, but are not limited to: a wireless access point (e.g., compliant to IEEE 802.11 and variants thereof), Bluetooth devices (e.g., compliant to Bluetooth standard and variants thereof); ZigBee (e.g., compliant to IEEE 802.15.4 and variants thereof); Worldwide Interoperability for Microwave Access (WiMAX, e.g. compliant to IEEE 802.16 and variants thereof); Universal Mobile Telecommunications System (UMTS); Code Division Multiple Access (CDMA) including all variants; Global System for Mobile Communications (GSM) and all variants; Time division multiple access (TDMA) and all variants; Long Term Evolution (LTE); 3G/4G; Direct Sequence Spread Spectrum; Frequency Hopping Spread Spectrum; wireless/cordless telecommunication protocols; wireless home network communication protocols; paging network protocols; satellite data communication protocols; wireless hospital or health care facility network protocols such as those operating in the Wireless Medical Telemetry bands; General packet radio service; Wireless Universal Serial Bus; and any other wireless data communication protocol.

A cavity 100 backing of the slot antenna 40, 60 is employed for at least two purposes. First, the cavity 100 suppresses one hemisphere of the bi-directional radiation characteristic of the slot antenna 40, 60. Second, the cavity 100 backing presents a convenient resonant and shielded structure that can be used for impedance matching and frequency broad-banding. Within that cavity 100 one skilled in the art can place fins, ridges, probes, septums, and other wave guide-like structures that can accomplish the impedance-matching and polarization-controlling goals. There are flat profile antenna systems that use a radial mode wave guide within the antenna. The omni-directional version of such an antenna tends to radiate out to the horizon. That kind of antenna in this application would place an undesirable amount of signal in directions that would illuminate the materials within the drop ceiling, and place too little of the energy down into the sales area of the store.

In an exemplary embodiment, the slot antennas 40, 60 may be utilized in low profile applications. For example, there is a demand for ceiling-mounted RFID reader systems that can perform an Automatic Inventory assessment of RFID tags that are affixed to pieces of merchandise that are contained within the sales area of a store (for instance). For such ceiling-mounted RFID reader systems, there is also a demand that the antennas used therein have a low profile, and present a minimum visibility. Those requirements place a premium on antennas systems that can present a tile-like flat profile into the viewable area below a drop ceiling (for instance). Thus a cavity backed slot antenna 40, 60 is a candidate for such a requirement.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

Further, it is expected that one of ordinary skill, notwithstanding possibly significant effort and many design choices motivated by, for example, available time, current technology, and economic considerations, when guided by the concepts and principles disclosed herein will be readily capable of generating software instructions and programs and ICs with minimal experimentation for use with the antenna apparatus and method.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A cavity backed cross-slot antenna, comprising:

a horizontal slot antenna disposed in an RF ground plane;

a vertical slot antenna disposed in the RF ground plane and sharing a center overlapping slot portion with the horizontal slot antenna, the horizontal slot antenna and the vertical slot antenna include a cavity backing;

a first feed for the horizontal slot antenna; and a second feed for the vertical slot antenna, the first feed and the second feed provided to the shared center portion and positioned diagonally with respect to one another at a center of each slot antenna to overlap orthogonally to alleviate radio frequency choking between the horizontal slot antenna and the vertical slot antenna when being symmetrically and simultaneously fed.

2. The cavity backed cross-slot antenna of claim 1, wherein the cavity backing presents a shielded structure.

3. The cavity backed cross-slot antenna of claim 1, wherein the horizontal slot antenna and the vertical slot antenna are one of integrally formed in the ground plate and disposed on the ground plate.

4. The cavity backed cross-slot antenna of claim 1, wherein the shared center portion is configured to be partially capacitive.

5. The cavity backed cross-slot antenna of claim 1, wherein the first feed and the second feed are positioned diagonally with respect to one another at the shared center portion to be overlapping to create a capacitive coupling therebetween.

6. The cavity backed cross-slot antenna of claim 5, wherein the capacitive coupling is negated by an inductor coupled between the feeds.

7. The cavity backed cross-slot antenna of claim 1, wherein the horizontal slot antenna and the vertical slot antenna are configured to be longer than a resonant length to make their impedance capacitive to negate feed series inductance.

8. The cavity backed cross-slot antenna of claim 1, wherein the first feed and the second feed each feed the horizontal slot antenna and the vertical slot antenna, respectively and simultaneously, with a single phase combination providing isolation in a radiated signal.

9. The cavity backed cross-slot antenna of claim 1, wherein the horizontal slot antenna and the vertical slot antenna are slightly asymmetrical to one another to create an imbalance reactance between them with one being capacitive and one being inductive resulting in a phase difference in the excitation.

10. A cavity backed cross-slot antenna, comprising:

a horizontal slot antenna disposed in an RF ground plane;

a vertical slot antenna disposed in the RF ground plane, the horizontal slot antenna and the vertical slot antenna share a center overlapping slot portion therebetween, the horizontal slot antenna and the vertical slot antenna include a cavity backing in a shielded structure;

a first feed feeding both halves of the horizontal slot antenna; and a second feed feeding both halves of the vertical slot antenna, the first and second feeds being positioned diagonally with respect to one another across a center of each slot antenna to overlap orthogonally to alleviate radio frequency choking between the horizontal slot antenna and the vertical slot antenna.

11. The cavity backed cross-slot antenna of claim 10, wherein the cavity backing presents a shielded structure.

12. The cavity backed cross-slot antenna of claim 10, wherein the horizontal slot antenna and the vertical slot antenna are one of integrally formed in the ground plate and disposed on the ground plate.

13. The cavity backed cross-slot antenna of claim 10, wherein the horizontal slot antenna and the vertical slot antenna are configured to be longer than a resonant length to make their impedance capacitive to negate feed series inductance.

14. The cavity backed cross-slot antenna of claim 10, wherein the first feed symmetrically feeds both the halves of the horizontal slot antenna and the second feed symmetrically feeds both the halves of the vertical slot antenna, the symmetrically feeding provides equal excitation to each half of the horizontal slot antenna and to each half of the vertical slot antenna.

15. The cavity backed cross-slot antenna of claim 10, wherein the horizontal slot antenna and the vertical slot antenna are slightly asymmetrical to one another to create an imbalance reactance between them that is frequency sensitive, resulting in a phase difference in the excitation between them that is frequency sensitive and an amplitude difference in the excitation between them that is frequency sensitive.

16. The cavity backed cross-slot antenna of claim 10, wherein the first feed and the second feed are positioned diagonally with respect to one another at the shared center portion to be overlapping to create capacitive coupling therebetween to be compensated by an inductance provided by an inductor coupled between the feeds.

17. The cavity backed cross-slot antenna of claim 10, wherein each of the first feed and the second feed comprise:

a common portion;

a split portion comprising a first half and a second half, the first half and the second half coupled therebetween and coupled to the common portion; and a first feed portion coupled to the first half and to one of the halves of one of the horizontal slot antenna and the vertical slot antenna, wherein a combined length of the split portions of each feed are equal in wavelength to provide co-phase excitation of each half of the appropriate slot antenna.

18. The cavity backed cross-slot antenna of claim 17, wherein:

a length of the first half of the split portion and the first feed portion is approximately equal to one half of a wavelength associated with the cavity backed cross-slot antenna; and a length of the second half of the split portion and the second feed portion is approximately equal to one half of a wavelength associated with the cavity backed cross-slot antenna, wherein the common portion and the split portion have different impedances.

19. The cavity backed cross-slot antenna of claim 10, wherein the first feed and the second feed are not interconnected therebetween.

20. A method, comprising:

providing a horizontal slot antenna and a vertical slot antenna disposed in an RF ground plane and overlapping therebetween in a shared center portion, the horizontal slot antenna and the vertical slot antenna comprising a cavity backing;

feeding each of the horizontal slot antenna and the vertical slot antenna at the center shared portion, the first and second feed being positioned diagonally with respect to one another to overlap orthogonally to alleviate radio frequency choking between the horizontal slot antenna and the vertical slot antenna due to the shared center portion; and operating the horizontal slot antenna and the vertical slot antenna being fed symmetrically and simultaneously in a polarization diverse manner.

* * * * *